US007284619B2

(12) United States Patent
Stokley et al.

(10) Patent No.: US 7,284,619 B2
(45) Date of Patent: Oct. 23, 2007

(54) PACKER WITH POSITIONABLE COLLAR

(75) Inventors: Charles O. Stokley, Houston, TX (US); Paul A. Reinhardt, Houston, TX (US); Doyle R. Warren, Spring, TX (US); Jackie D. Newberry, Houston, TX (US)

(73) Assignee: Tam International, Inc., Houston, TX (US)

( * ) Notice: Subject to any disclaimer, the term of this patent is extended or adjusted under 35 U.S.C. 154(b) by 258 days.

(21) Appl. No.: 11/049,159

(22) Filed: Feb. 2, 2005

(65) Prior Publication Data

US 2006/0169466 A1 Aug. 3, 2006

(51) Int. Cl.
*E21B 33/12* (2006.01)
*E21B 34/14* (2006.01)

(52) U.S. Cl. ..... 166/387; 166/386; 166/332.4; 166/330; 166/181; 166/142

(58) Field of Classification Search ..... 166/316, 166/319, 321, 323, 330, 386, 387, 181–183, 166/185, 142, 285, 151, 187, 332.4, 334.1
See application file for complete search history.

(56) References Cited

U.S. PATENT DOCUMENTS

| | | | | |
|---|---|---|---|---|
| 1,684,551 A | | 9/1928 | Manning | |
| 2,435,016 A | | 1/1948 | Pitts | |
| 2,602,510 A | | 7/1952 | Baker | |
| 2,659,438 A | | 11/1953 | Schnitter | |
| 2,862,562 A | * | 12/1958 | Hughes | 166/151 |
| 2,928,470 A | | 3/1960 | Baker | |
| 2,994,378 A | * | 8/1961 | Reistle, Jr. | 166/72 |
| 3,247,905 A | | 4/1966 | Baker | |
| 3,464,493 A | | 9/1969 | Chancellor et al. | |
| 3,503,445 A | | 3/1970 | Cocbrum et al. | |
| 3,527,297 A | | 9/1970 | Todd | |
| 3,552,486 A | * | 1/1971 | Burns et al. | 166/147 |
| 3,941,190 A | * | 3/1976 | Conover | 166/187 |
| 3,948,322 A | | 4/1976 | Baker | |
| 4,244,590 A | | 1/1981 | Sanford | |
| 4,424,860 A | | 1/1984 | McGill | |
| 4,479,545 A | | 10/1984 | Eley | |
| 4,499,947 A | | 2/1985 | Zskoa et al. | |
| 4,566,535 A | | 1/1986 | Sanford | |
| 4,823,882 A | | 4/1989 | Stokley et al. | |
| 4,850,432 A | | 7/1989 | Porter et al. | |
| 5,024,273 A | | 6/1991 | Coone et al. | |
| 5,109,925 A | | 5/1992 | Stepp et al. | |
| 5,297,633 A | | 3/1994 | Snider et al. | |
| 5,314,015 A | | 5/1994 | Streich et al. | |
| 5,375,662 A | | 12/1994 | Echols, III et al. | |
| 5,383,520 A | | 1/1995 | Tucker et al. | |
| 5,400,855 A | | 3/1995 | Stepp et al. | |
| 5,488,994 A | | 2/1996 | Laurel et al. | |
| 5,655,607 A | * | 8/1997 | Mellemstrand et al. | 166/386 |
| 5,711,372 A | | 1/1998 | Stokley | |

* cited by examiner

*Primary Examiner*—Kenneth Thompson
(74) *Attorney, Agent, or Firm*—Browning Bushman P.C.

(57) ABSTRACT

A fluid actuated packer 10 and collar 36 assembly is provided for positioning on a tubular member 12. The collar 36 is moveable by a running tool 110 positioned within the tubular member and has a closed position and a packer activate position, fluidly connects the collar 36 to the packer element 14 when in the packer activate position, and closes off the flow path 26 when in the closed position. According to a method of the invention, the flow path 26 extends from the collar to the expandable packer element 14 and is open to activate the packer element 14 and closes off the flow path 26 when in the closed position.

23 Claims, 5 Drawing Sheets

PACKER WITH POSITIONABLE COLLAR

FIELD OF THE INVENTION

The present invention relates to fluid energized packers used in downhole operations to seal an annulus about a casing. More particularly, the invention relates to a packer with fluid communication to the packer element being controlled by a moveable port collar within the casing, with a port collar optionally also providing controlled communication between the interior and the exterior of the casing suitable for cementing operations.

BACKGROUND OF THE INVENTION

In many oil and gas wells where cementing casing in an existing borehole is required, a cement column must be placed from the bottom of the well to or near the surface. The strength of the formation (rock) may not allow such placement in a single pumping program. In such cases, a multiple stage cementing program must be achieved.

In order to achieve more than one circulation of cement, devices are provided to open and close a hole in the casing. Such devices known as "stage tools" are operated between the open and closed positions using hydraulic forces, including plugs displaced from the surface to the tool. Port collars serve a similar purpose, and are opened by a mechanical shifting device on a tubular string (work string) inside the casing.

In addition to providing the device to open and close a hole in the casing, many applications also require the use of a packer to seal the annulus between the casing and open hole to support the additional hydrostatic pressure which will be exerted by the higher density cement slurry when placed into the annulus. Devices used to achieve this seal are commonly known as casing packers, and may consist of an inflatable device or compression seal device, each activated by the application of fluid pressure from the inside of the casing to the expandable packer element.

Typically, inflatable packers contain two or more valves in a packer head. One valve normally controls the pressure at which inflation is initiated, and a second valve controls the maximum pressure that is applied to the packer. In cases where the inflatable packer element ruptures during the inflation process or afterwards, these valves are designed to fail in a position which does not leave a flow path between the inside of the casing and the annulus.

Due to varying conditions in wells, these fail safe valves do not always function properly and may require remedial operations to eliminate the flow path, such as squeezing cement into the valve ports. Such operations can be expensive but must be successful in order to continue drilling deeper or completing the well for production of oil or gas. Similar valves in compression seal packers have the same shortcomings, and may similarly require a cement squeezing operation to close off flow to the annulus.

A standard procedure for achieving a two-stage cementing program is to pump a volume of cement down the inside of the casing and out the end. The volume pumped is determined by the capacity of the formations to withstand the additional hydrostatic pressure applied by the cement column without fracturing or otherwise causing the cement to penetrate into the formations. When such second stage cementing operations are achieved by using a "stage tool," any cement left inside the casing and the displacement plugs that activate opening or closing of the ports must be removed by drilling through the tool, since no circulation is possible once the packer is set. Drilling cement and plugs from the inside of a stage tool can be difficult, particularly at shallow depths where there may be minimal weight of the pipe string used for such drilling, so that drilling penetration rates through the cement and plugs are slow. Hydraulically operated stage tools also require a large cement pumping volume due to the diameter of the casing, and hydraulic plugs may have sealing reliability problems.

Particularly in wells where the second stage application is shallow, a few hundred feet for example, the port collar device is preferred as such is opened, closed and tested by a mechanical shifting device run on a tubular, such as drill pipe. Any excess cement left in the tubing or casing may be removed by circulation between the interior of the casing and the interior of the drill pipe.

Relevant patents include U.S. Pat. Nos. 1,684,551, 2,435,016, 2,602,510, 2,659,438, 2,928,470, 3,247,905, 3,464,493, 3,503,445, 3,527,297, 3,948,322, 4,424,860, 4,479,545, 4,499,947, 4,850,432, 5,024,273, 5,109,925, 5,297,633, 5,314,015, 5,375,662, 5,383,520, 5,488,994, and 5,400,855.

The disadvantages of the prior art are overcome by the present invention, and an improved packer with a controlled port collar is hereinafter disclosed.

SUMMARY OF THE INVENTION

In one embodiment, a casing annulus packer may be positioned along the casing string at a depth above the top of the first cement stage and is inflated or otherwise activated to achieve a seal between the casing and the borehole wall once a plug device placed behind the cement reaches a seal near the bottom of the well. Activating this annulus seal is typically achieved by increasing pressure inside the casing to open the inflation valve in the packer head. Activation immediately after placement of the first stage cement slurry also prevents fluid movement, such as natural gas from below the packer to above, in addition to the later requirement to support the second stage cement column hydrostatic pressure.

In one embodiment, a port collar is provided on the casing above an inflatable casing annulus packer. The port collar may provide for opening and closing a port from inside the casing to outside to facilitate pumping cement into the annulus. The port collar also has a position wherein the flow path to the expandable packer element is open to activate the packer, and another position in which the flow path is closed from communication to the inside of the casing. The port collar may be operated between positions by manipulation of the work string and mechanical activation of a tool run on the work string. The port collar may be fluidly coupled to various types of fluid activated packers, including inflatable packers and compression seal packers.

These and further features and advantages of the present invention will become apparent from the following detailed description, wherein reference is made to the figures in the accompanying drawings.

DETAILED DESCRIPTION OF PREFERRED EMBODIMENTS

A downhole packer is provided with a mechanically controlled collar positioned on a mandrel. In one embodiment, the collar is rotatable to control the injection of cement from the interior to the exterior of the tool, or to pass cement to the bladder to activate the packer, or to close off both the cementing ports and the packer activate ports. In another embodiment, the collar is axially moveable between a cementing position for passing cement from the interior to the exterior of the tool, an inflate position allowing cement to pass to the interior of the bladder to inflate the packer, and a closed position to close off both the cementing ports and the inflate ports.

Figure 1:
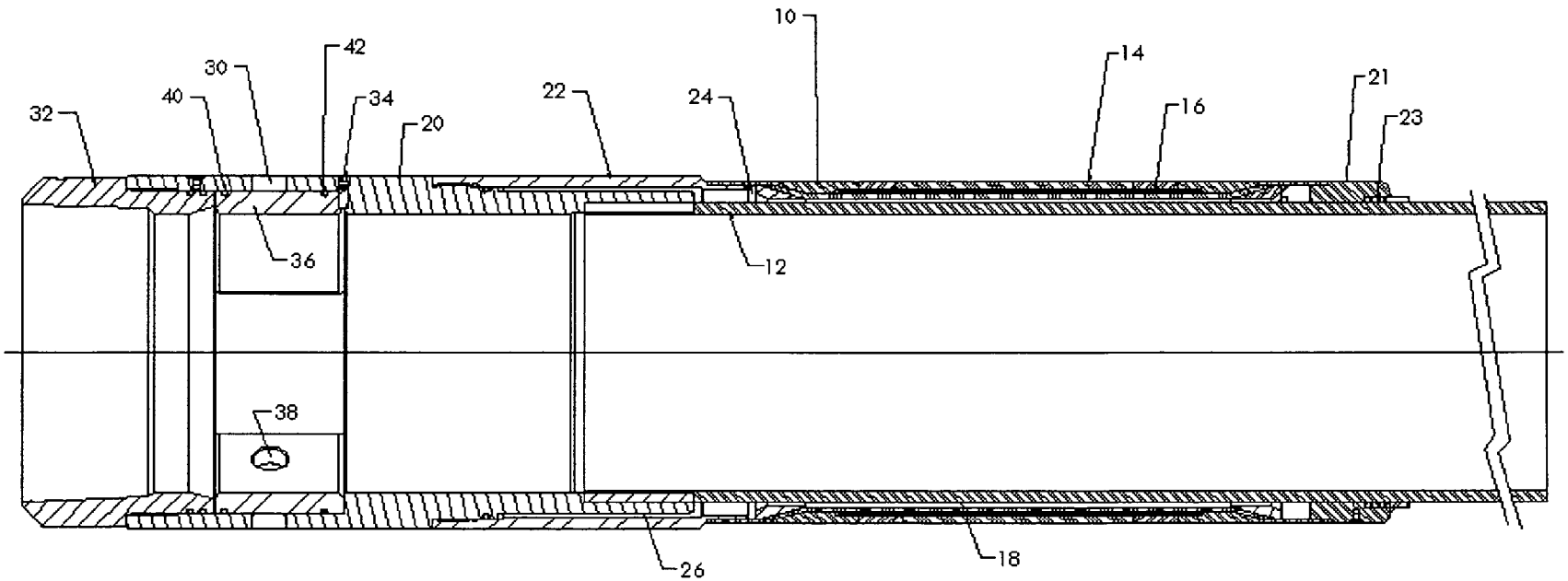
FIG. 1 illustrates a rotatable port collar in the closed position.

FIG. 1 discloses an inflatable packer 10 having an interior mandrel 12 and an elastomeric bladder 14 radially outward of the mandrel 12. The mandrel 12 is functionally part of a tubular member positioned downhole in a well. Circumferentially spaced slats 16 may be positioned between the bladder layers, and assist in preventing rupture of the bladder under high fluid pressure. As explained subsequently, cement or other fluid may be injected from the interior of the tubular mandrel to the annular space 18 between the mandrel 12 and the bladder 14, thereby inflating the bladder 14 when fluid pressure is increased. An upper packer head 20 is threadably secured to the mandrel 12, and includes one or more circumferentially spaced flow ports 30 therein. Sleeve 22 is threadably connected at its upper end to the packer head 20, with a lower portion 24 of the sleeve 22 being sealed to the upper end of the bladder 14. An annular passageway 26 is provided between an exterior portion of the head 20 and an interior surface of the sleeve 22, so that fluid passes through the passageway 26 and into the annular passageway 18 to inflate the bladder when the collar 36 is in the inflate position. Conventional threaded connector 32 is provided at the upper end of the head 20 for interconnecting the tool to a conventional tubular (not shown).

The rotatable collar 36 includes one or more ports 38 therein, with a seal 40 provided above the ports 38 and another seal 42 provided below the ports 38. When the collar 36 is in the circulate or cementing position, a port 38 is aligned with the port 30 in the body 20, and fluid will pass from the interior of the tool through the ports 38 and 30, and to the annulus surrounding the downhole tool. A plurality of circumferentially spaced pins 34 may be provided for engagement with the lower end of the rotatable collar 36, and preferably reduce friction between the collar 36 and the packer head 20.

As shown in FIG. 1, an upper packer head 21 is slidably moveable along an exterior surface of the mandrel 12 during inflation of the bladder 14, with the lower end of bladder 14 being sealed to the lower packer head 20. Conventional sealing member 23 acts between the upper packer head 21 and the mandrel 12 to prevent the escape of fluid from between the mandrel 12 and the bladder 14. Each of the upper and lower packer heads thus seal with the mandrel 12.

Figure 2:
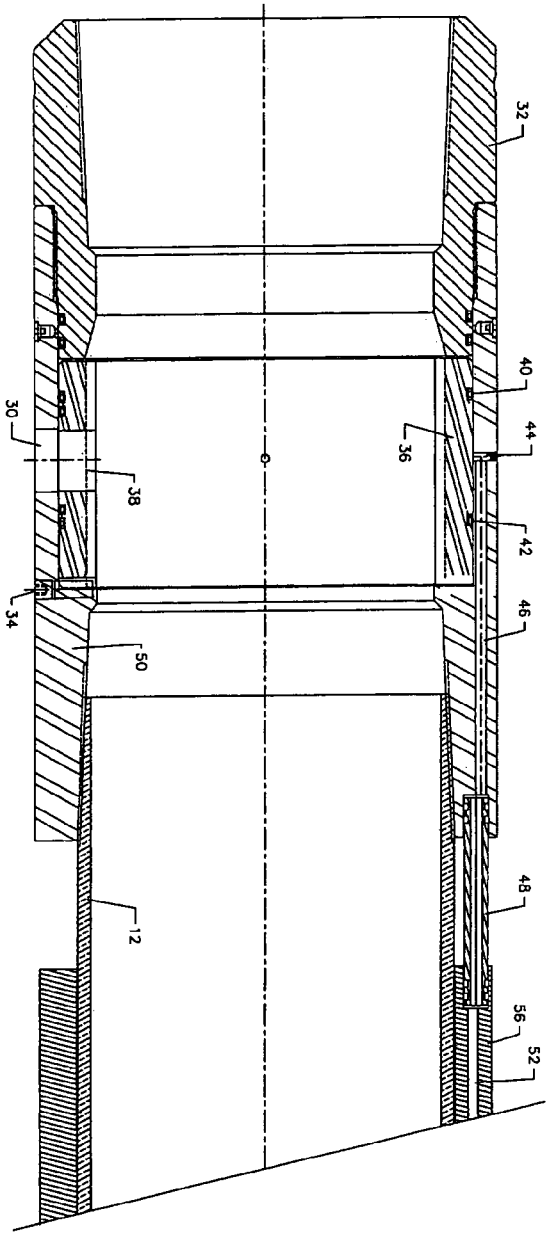
FIG. 2 illustrates the port collar as shown in FIG. 1 in the cementing position.

FIG. 2 discloses an alternate embodiment of a portion of the packer shown in FIG. 1, with the same reference numeral being used for functionally similar components. The rotatable collar 36 thus includes a port 38 which, as shown in FIG. 2, is align with the port 30 to pump cement into the annulus about the tool. When rotated to another position, port 30 is aligned with the horizontal port 44 in the sub 50, which is plugged at its radially outward end, and is in communication with vertical passageway 46 through the sub 50. In this embodiment, passageway 46 in the sub 50 is in fluid communication with a passageway through the flowline 48, which is sealed at its upper end to the sub 50 and its lower end to the upper packer head 20.

Figure 3:
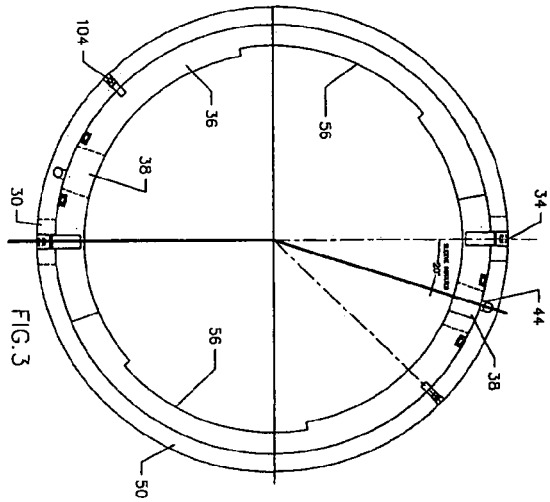
FIG. 3 illustrates the port collar in the inflate position.

FIG. 3 illustrates the tool as shown in FIG. 2 with the inflation port 44 opened and the cementing port 30 closed. Port 38 in the collar 36 is thus in fluid communication with the port 44, while the inflation port 30 is fluidly isolated from the port 38 in the collar. FIG. 3 also shows a pair of radially opposing recesses 56 in the collar 36 for cooperation with a suitable running tool (not shown) to selectively rotate the collar 36.

Figure 4:
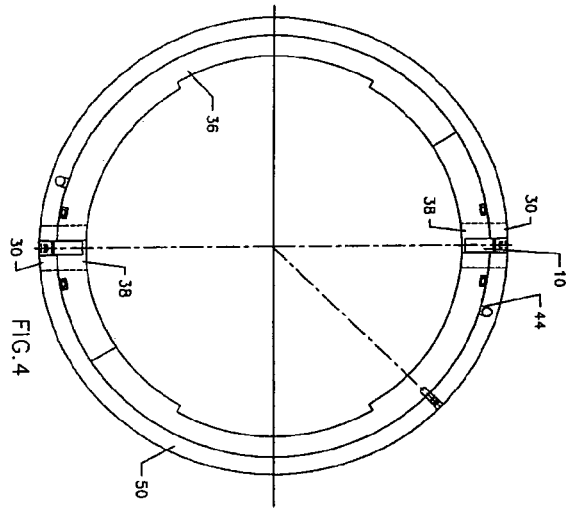
FIG. 4 depicts a rotatable collar in the cementing position.
Figure 5:
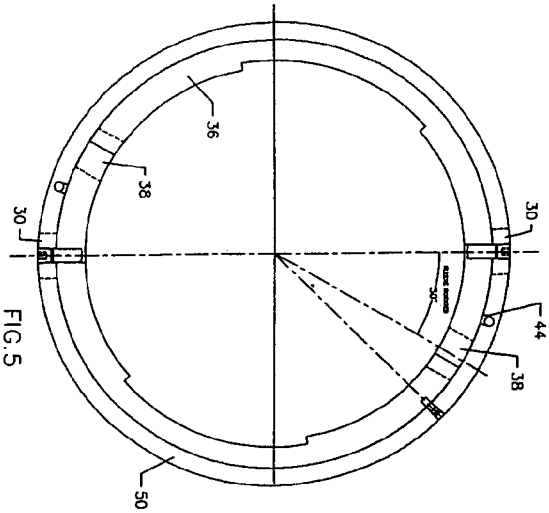
FIG. 5 depicts a rotatable collar in the closed position.

In the FIG. 4 position, the collar 36 has been rotated so that the port 38 is aligned with the port 30, and the passageway 44 is fluidly isolated from the port 38. Accordingly, the inflation port 44 is now closed and the cementing port 30 is open so that fluid may be injected into the annulus surrounding the tool. In the FIG. 5 position, both the inflation port 44 and the cementing port 30 are fluidly isolated from the port 38 in the collar, such that in this closed position, cement will not flow to the bladder and will not flow through the cementing port. Fluid within the tubular will thus pass downward through the tubular string and to components beneath the packer.

Figure 6:
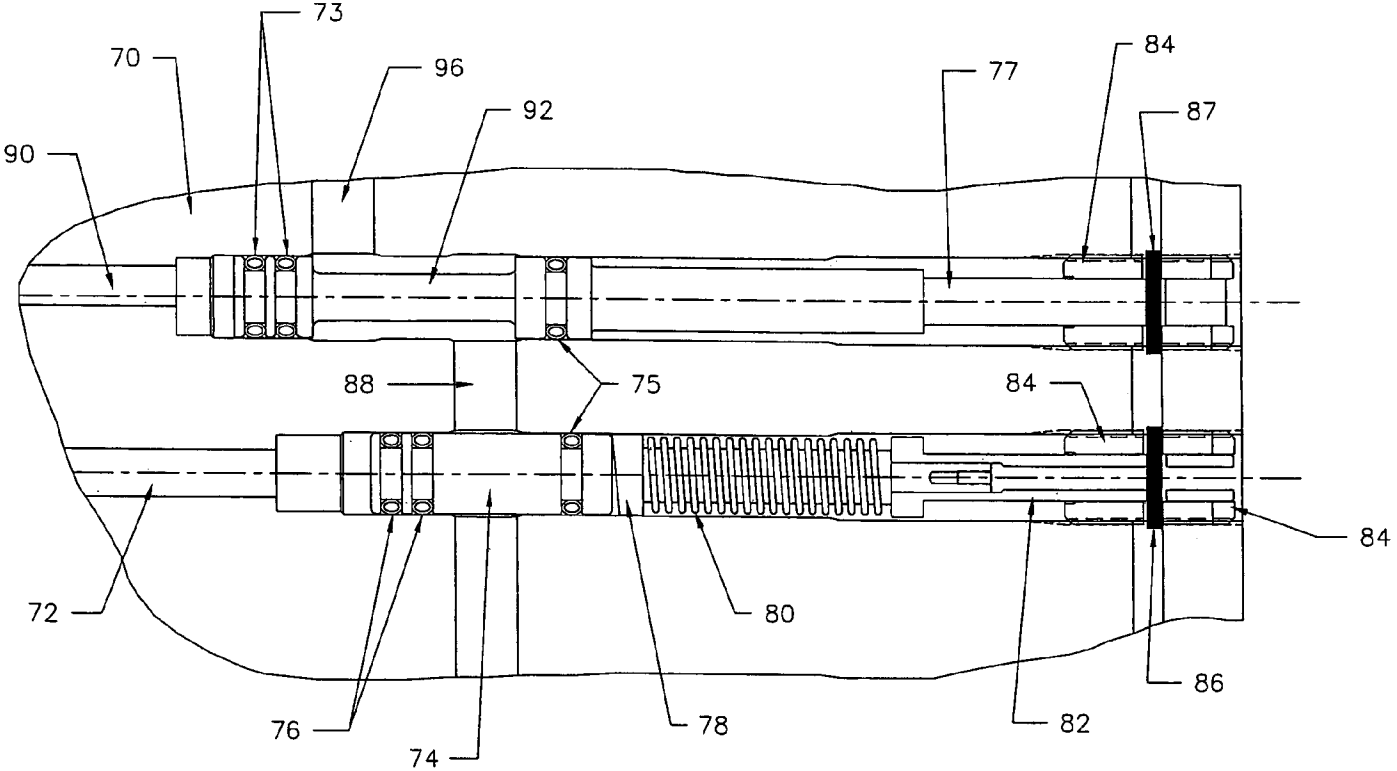
FIG. 6 illustrates an opening valve and a closing valve which may be positioned within the packer head along the flow path.

Those skilled in the art will recognize that an inflatable packer preferably includes conventional valving in one of the upper head and the lower head for controlling the flow to the inflatable bladder. Referring to FIG. 6, fluid in the passageway 72 which is in fluid communication with the packer activate port thus acts on the piston 74, which is sealed to the head by seals 76. The opening valve or piston 74 as shown in FIG. 6 is in its run-in position, which blocks fluid from passing to the bladder. As pressure is increased in passageway 72, the piston 74 moves downward, shearing the pin 86 between the pair of end plugs 84, so that the seals 76 pass below the connecting passageway 88, compressing the spring 80 on the lock rod 78 and moving the shear sleeve 82 downward. In this position, fluid may thus flow from passageway 72 to connecting passageway 88, and then to passageway 96 to inflate the bladder.

Once the bladder is properly inflated, the pressure differential between the passageway 90, which is in fluid communication with the passageway 96, and the pressure acting on the pin 77 shears the pin 87, so that the seals 73 move downward past the passageway 96, thereby closing off flow in the passageway 88 to the passageway 96. Closing valve 92 and seal 73 may thus be moved to a valve closed position for closing off flow to the packer element. At this stage, the packer is thus fully inflated or set. By bleeding the applied pressure from the casing ID, the opening valve 74 moves back to its original position and permanently locks in the closed position.

The disclosed port collar thus adds a secondary closure member to assure closure of the flow path to the packer in case of packer failure and to provide additional protection for the valves in the packer head which operate the packer from exposure to well fluids, such as saturated brine, carbon dioxide, hydrogen sulfide, natural gas, acids and other potentially corrosive fluids often contained in oil and gas wells.

Figure 7:
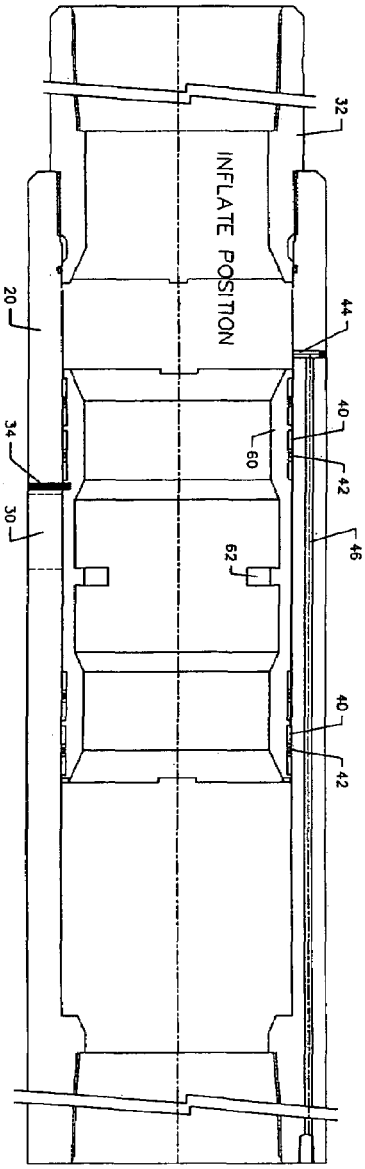
FIG. 7 illustrates an axially moveable collar in the inflate position.
Figure 8:
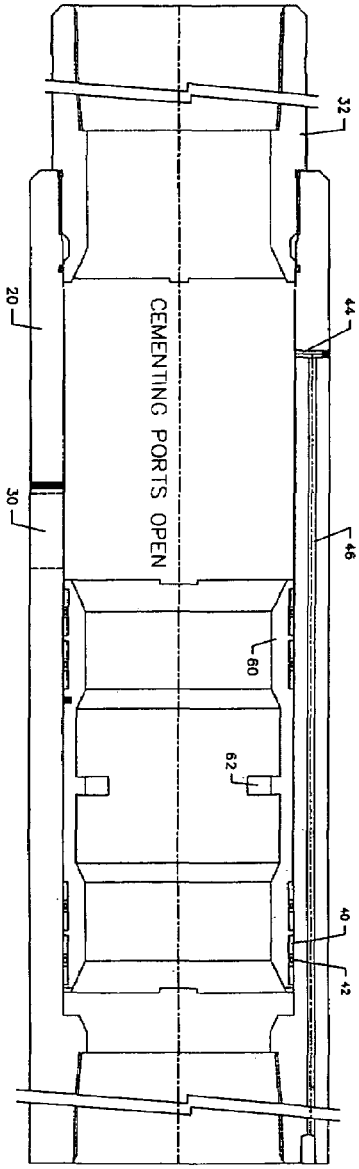
FIG. 8 illustrates the collar as shown in FIG. 7 in the cementing position.
Figure 9:
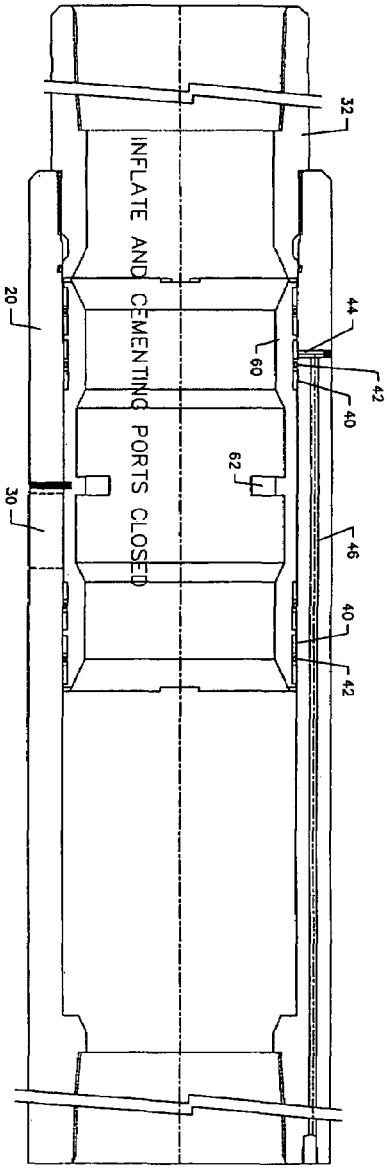
FIG. 9 illustrates the collar as shown in FIG. 7 in the closed position.

FIGS. 7, 8 and 9 illustrate a portion of the inflatable packer with a sliding collar. Again, the same reference numbers are used to describe similar components. The packer head 20 as shown in FIG. 7 is threadably connected to the top sub 32, and includes a vertical flow passageway 46 in fluid communication with horizontal passageway 44, which is plugged at its outermost end. The port 30 in the sidewall of the body 20 is plugged by the sleeve 60 and seals 40 and 42. Recesses 62 in the wall of the sliding plug 60 are provided for cooperation with a tool to axially position the sleeve 60 with respect to the body 20. FIG. 7 thus illustrates the sleeve in the inflate or packer activate position, since port 44 is above the seals 40 and 42.

Shifting to FIG. 8 position, the cementing port 30 is open since the seals 40 and 42 are now below both the port 44 and the port 30 in the sidewall of body 20. The flow area through the port 30 is substantial compared to the flow area through the elongate passageway 46. The fluid passes out the port 30 and into the annulus surrounding the tool. The passageway 46 is closed by the valving in the packer head.

In the FIG. 9 position, the collar 60 is shifted upward until both the port 44 and the port 30 are isolated by the seals 40 and 42, such that fluid is not pumped through port 30 or to the inflatable bladder.

The collar may be initially run in the well in the inflate position, so that the tool may be run in the well and the pumped cement used to inflate the bladder before the running tool shifts the collar to the cementing position, and then to the closed position. In the rotatable tool, rotation by the running tool to the left preferably opens the collar to pump fluid into the annulus, while rotation to the right closes the collar. Each of the rotating collar and the sliding collar embodiments have particular advantages, since normal rotation of a tubular string to the right will maintain the collar in the closed position, and rotation to the left will open the cement port or the inflation port. The torque required to rotate the collar is preferably relatively low, however, since the operator will not want to risk unthreading the connecting threads along the length of the string above the tool. In the slidable collar embodiment shown in FIG. 7-9, the collar could be jilted to an alternate position if the tool were to hit an object while descending in the well, although there should be no concern with respect to unthreading of the tubular connectors above the tool.

In another version, the collar is manipulated by a hydraulically activated running tool, rather than a tool which is mechanically manipulated to rotate or shift the collar. Hydraulically actuated operating devices for shifting components of downhole tools are well known in the art, and utilize changes in fluid pressure within the tool rather than mechanical movements to shift components of the running tool and thus rotate or shift a collar connected to the running tool. Conventional hydraulically operated running tools may use wiper plugs to generate the desired downhole pressure changes. To ensure that the port collar is maintained in the packer activate or inflate position as it is run in a well, shear pins 34 as shown in FIGS. 3 and 7 may be utilized. The shear pins will thus require an appreciable torque for the rotating collar or an axial load to the slidable collar to shear the pins and thus allow for the collar to move to the cementing or closed position.

As disclosed above, cement is a conventional fluid which may be pumped through the tubular and used to both inflate the packer element and cement the tubular in the well. In other applications, other fluids may be used to activate the packer and/or to fill the annulus about the tubular, including brines, epoxy fluids, gels, and other chemicals, including completion or remedial fluids.

The above discussion has concentrated upon using the fluid within the tubular string to activate an inflatable packer. In other embodiments, the same port collar, flow path, and valving techniques as disclosed herein may be used to activate compression seal packers which have similar valving within the flow path to activate the packer. Also, the above description of both the rotatable and the sliding port collars allow for each port collar to have three positions: a cementing position, a packer activate position, and a closed position. In another embodiment, one port collar may be utilized which has a packer activate position and a closed position, and another port collar used which has a cementing position and a closed position. It is a particular feature of the invention, however, that the port collar include the three positions as disclosed herein, such that the same collar may be manipulated to achieve the cementing, packer activation, and closing functions.

Figure 10:
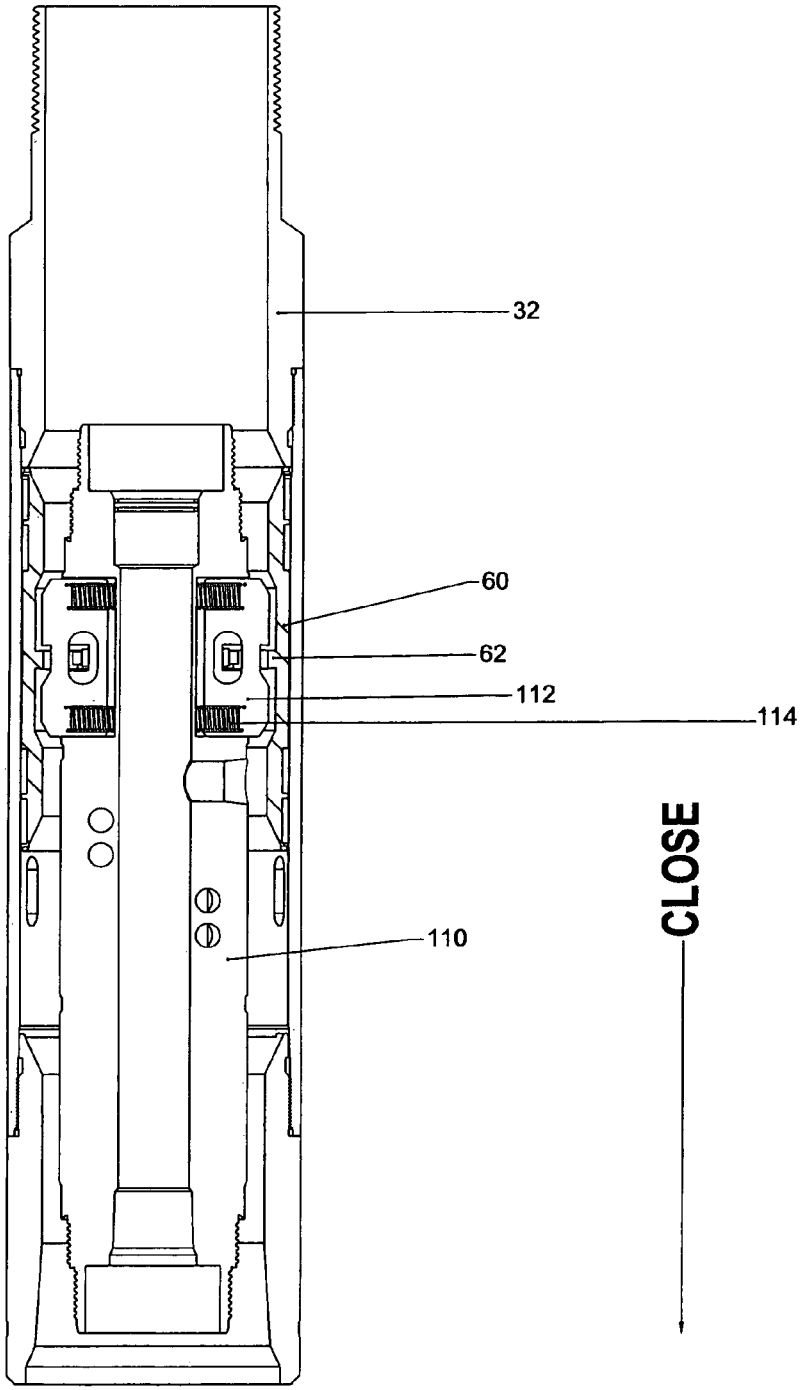
FIG. 10 illustrates a position of a running tool for mechanically manipulating a sliding collar.

FIG. 10 discloses a portion of a suitable running tool 110 for manipulating a sliding sleeve 60. The running tool 110 includes radially moveable dogs 112, which are bias by springs 114 to move radially outward to engage the projections 62 on the sleeve 60.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed:

1. A fluid actuated packer and collar assembly for positioning downhole on a tubular member, the packer and collar assembly comprising:

first and second axially spaced packer heads each supported on and circumferentially surrounding the tubular member;

an expandable packer element extending axially between the first and second packer heads;

a movable collar supported on and positioned within the tubular member, the collar having a closed position and a packer activate position;

a flow path extending from an interior of the tubular member to the expandable packer element for activating the packer element when the collar is in the packer activate position and for closing off the flow path when the collar is in the closed position;

a closing valve positioned along the flow path downstream from the collar for closing off flow to the packer element when in a valve closed position; and a running tool positioned within the tubular member for mechanically moving the collar from the closed position to the packer activate position.

2. A packer and collar assembly as defined in claim 1, wherein the collar is a sleeve shaped member with a port therein establishing fluid communication between the interior of the tubular member and the flow path when in the packer activate position.

3. A packer and collar assembly as defined in claim 1, wherein the collar is rotated between the closed position and the packer activate position by the running tool.

4. A packer and port collar assembly as defined in claim 1, wherein the collar is axially movable between the closed position and the packer activate position by the running tool.

5. A packer and collar assembly as defined in claim 1, further comprising:

one of the collar and another collar having a circulate position establishing fluid communication between the interior of the tubular member and an annulus about the tubular member, the one of the collar and the another collar in the closed position preventing fluid communication between the interior of the tubular member and the annulus about the tubular member.

6. A packer and collar assembly as defined in claim 1, further comprising:

a shear member for preventing unintentional movement of the collar.

7. A packer and collar assembly as defined in claim 1, wherein the packer is an inflatable packer.

8. A packer and collar assembly as defined in claim 1, wherein the closing valve is responsive to a pressure differential between an interior of the packer element and the flow line to move to the valve closed position.

9. A packer and collar assembly as defined in claim 8, wherein the closing valve is supported on one of the first and second packer heads.

10. A packer and collar assembly as defined in claim 1, further comprising:

an opening valve positioned along the flow path downstream from the collar for opening the flow line to the packer element in response to a selected pressure differential.

11. An inflatable packer and collar assembly for positioning downhole on a tubular member, the tubular member including a radial throughport for passing fluid from an interior of the tubular member to an annulus about the tubular member, the packer and collar assembly comprising:

first and second axially spaced packer heads each supported on the tubular member;

an expandable packer element extending between the first and second packer heads;

a movable collar supported on the tubular member, the collar having a circulate position establishing fluid communication between the interior of the tubular member and the radial throughport, a closed position blocking fluid communication between the interior of the tubular member and the radial throughport, and an inflate position;

a flow path extending from the collar to the expandable packer element for inflating the packer element when the collar is in the inflate position and for closing off the flow path when the collar is in the closed position; and a closing valve positioned along the flow oath downstream from the collar for closing off flow to the packer element when inflated.

12. An inflatable packer and collar assembly as defined in claim 11, wherein the collar is axially movable between the closed position and the inflate position by a running tool.

13. An inflatable packer and collar assembly as defined in claim 11, wherein the closing valve is supported on one of the first and second packer heads.

14. An inflatable packer and collar assembly as defined in claim 11, further comprising:

an opening valve positioned along the flow path downstream from the collar for opening the flow line to the expandable packer element in response to a selected pressure differential.

15. A method of operating an expandable packer positioned downhole on a tubular member, the method comprising:

supporting first and second axially spaced packer heads each on the tubular member, an expandable packer element extending axially between the first and second packer heads;

supporting a movable collar on the tubular member, the collar having a closed position and a packer activate position;

providing a flow path extending from an interior of the tubular member to the expandable packer element for actuating the packer element when the collar is in the packer activate position and for closing off the flow path when the collar is in the closed position;

positioning a running tool within the tubular member for moving the collar; and positioning an opening valve along the flow path downstream from the collar for opening the flow path to the packer element in response to a selected pressure differential.

16. A method as defined in claim 15, wherein the collar is rotated between the closed position and activate position by the running tool.

17. A method as defined in claim 15, wherein the collar is axially movable between the closed position and the activate position by the running tool.

18. A method as defined in claim 15, further comprising:

one of the port collar and another collar having a circulate position establishing fluid communication between the interior of the tubular member and an annulus about the tubular member, the one of the collar and another collar in the closed position preventing fluid communication between the interior of the tubular member and the annulus about the tubular member.

19. A method as defined in claim 15, further comprising:

automatically closing a valve positioned along the flow path downstream from the collar when the packer element is activated.

20. An inflatable packer and collar assembly for positioning downhole on a tubular member, the tubular member including a radial throughport for passing fluid from an interior of the tubular member to an annulus about the tubular member, the packer and collar assembly comprising:

first and second axially spaced packer heads each supported on the tubular member, each packer head sealed with the tubular member, and at least one packer head slidably movable along an exterior surface of the mandrel;

an expandable packer element extending between the first and second packer heads;

a movable collar supported on the tubular member, the collar having a circulate position establishing fluid communication between the interior of the tubular member and the radial throughport, a closed position blocking fluid communication between the interior of the tubular member and the radial throughport, and an inflate position; and a flow path extending from the collar to the expandable packer element for inflating the packer element when the collar is in the inflate position and for closing off the flow path when the collar is in the closed position.

21. An inflatable packer and collar assembly as defined in claim 20, further comprising:

an opening valve positioned along the flow path downstream from the collar for opening the flow line to the expandable packer element in response to a selected pressure differential.

22. An inflatable packer and collar assembly as defined in claim 20, wherein the collar is rotated between the closed position and activate position by the running tool.

23. An inflatable packer and collar assembly as defined in claim 20, further comprising:

one of the port collar and another collar having a circulate position establishing fluid communication between the interior of the tubular member and an annulus about the tubular member, the one of the collar and another collar in the closed position preventing fluid communication between the interior of the tubular member and the annulus about the tubular member.

* * * * *

UNITED STATES PATENT AND TRADEMARK OFFICE

CERTIFICATE OF CORRECTION

PATENT NO. : 7,284,619 B2
APPLICATION NO. : 11/049159
DATED : October 23, 2007
INVENTOR(S) : Charles O. Stokley et al.

It is certified that error appears in the above-identified patent and that said Letters Patent is hereby corrected as shown below:

On The Title Page, Item (73) Assignee:, delete "Tam" and insert therefor --TAM--.

In column 7, line 59, delete "oath" and insert therefor --path--.

In column 8, line 25, delete "path" and insert therefor --line--.

Signed and Sealed this

First Day of January, 2008

JON W. DUDAS
*Director of the United States Patent and Trademark Office*